United States Patent [19]

Adamek

[11] 4,166,529

[45] Sep. 4, 1979

[54] CYLINDER STYLE DISPLAY BOX

[75] Inventor: David Adamek, Minneapolis, Minn.

[73] Assignee: Champion International Corporation, Stamford, Conn.

[21] Appl. No.: 886,345

[22] Filed: Mar. 14, 1978

[51] Int. Cl.[2] ..... B65D 65/16

[52] U.S. Cl. ..... 206/45.34; 229/16 D; 229/23 AB

[58] Field of Search ..... 206/45.33, 45.34; 229/23 AB, 16 R, 16 D, 23 R

[56] References Cited

U.S. PATENT DOCUMENTS

| | | | |
|---|---|---|---|
| 2,531,255 | 11/1950 | Clarke | 229/23 R |
| 2,851,208 | 9/1958 | Samsing | 229/23 R |
| 3,184,139 | 5/1965 | Conescu | 229/23 R |
| 3,608,705 | 9/1971 | Moshel | 229/23 R |
| 3,622,063 | 11/1971 | McVeigh | 229/23 R |
| 4,026,411 | 5/1977 | Johnson | 229/16 D |

*Primary Examiner*—William Price
*Assistant Examiner*—Joseph M. Moy
*Attorney, Agent, or Firm*—Evelyn M. Sommer

[57] ABSTRACT

A cylinder type display box is made from a single sheet of paperboard material and includes a base and two upstanding sidewalls. The display box further includes a tubular plastic sleeve member disposed over the base and sidewalls so as to form a plastic front wall, top wall, and back wall. The base and sidewalls of the box are generally prismatic in configuration, each having spaced apart panel members. The base includes a pair of substantially parallel locking slits extending from the front wall to the back wall, each of the locking slits being adjacent to one of the sidewalls. Each locking slit includes an elongated central portion and a pair of end portions, the end portions of each slit being flared toward its adjacent sidewall. Each of the sidewalls has a locking portion receivable in the locking slit adjacent thereto. Each locking portion includes a central portion integral with the respective sidewall and a pair of end tabs. The central locking portion of each sidewall is received in the elongated portion of its respective locking slit. The end tabs of each sidewall are received in the flared end portions of its respective locking slit thus, locking the sidewalls into the base portion.

13 Claims, 5 Drawing Figures

CYLINDER STYLE DISPLAY BOX

BACKGROUND OF THE INVENTION

The subject invention relates to a cylinder type display box which may be typically used to house merchandise for sale such as, for example, cameras. The display box of the subject type includes a base portion and a pair of upstanding sidewalls. The box further includes a tubular plastic sleeve member disposed over the sidewalls and base portion so as to provide the box with a see-through front wall, top wall, and back wall. Thus, the merchandise, while being fully enclosed within the box, is within plain view of potential purchasers.

It is an object of the subject invention to provide a cylinder type display box which may be made from a single sheet of paperboard material, and which, while being simple in construction, is sturdy and provides sufficient protection to a delicate article of merchandise, such as a camera.

It is a further object of the subject invention to provide a display box having the above characteristics which is relatively inexpensive to manufacture.

SUMMARY OF THE INVENTION

In accordance with the subject invention, a cylinder type display box is made from a single sheet of paperboard material and includes a base and two upstanding sidewalls. The box also includes a tubular transparent plastic sleeve member which is disposed over the base and sidewalls so as to provide the subject box with a see-through front wall, top wall, and back wall. The base and sidewalls are generally prismatic in configuration, each having spaced apart panel members. The base of the subject box includes a pair of locking slits which extend from the front wall to the back wall of the box, each of the slits being adjacent to one of the sidewalls. Each locking slit comprises an elongated central portion and a pair of end portions which flare towards the respective sidewall immediately adjacent thereto. Each sidewall of the subject box includes a locking portion which is received in the locking slit immediately adjacent thereto. Each of said locking portions includes a central portion integral with its respective sidewall and a pair of end tabs. The end tabs of each sidewall are received in the flared end portions of the respective locking slit immediately adjacent thereto.

The blank for forming the subject display box comprises a substantially rectangular paperboard substrate having a plurality of cuts and vertical and horizontal fold lines subdividing the substrate into a plurality of panel members. The blank includes a first inner side panel having a top glue flap hingedly connected to the top edge thereof and a lateral glue flap hingedly connected to one side thereof. The other side of the first inner side panel is cut from the substrate so as to provide the first inner side panel with a side edge. In addition, the first inner side panel includes a pair of end cuts which are adjacent the side edge, the cuts providing the panel with a pair of lateral locking tabs. A first side separator panel is hingedly connected to the bottom edge of the first inner side panel. A first outer side panel is hingedly connected to the first side separator panel, the first outer side panel including a lateral glue flap hingedly connected to one side of the panel. A bottom glue flap is hingedly connected to the bottom portion of the panel. The top glue flap of the first inner side panel and the bottom glue flap of the first outer side panel are adapted to overlap and adhere to one another. The subject blank further includes a second inner side panel having a top glue flap hingedly connected to the top edge thereof and a lateral glue flap hingedly connected to one side thereof. The substrate is cut along the length of the second inner side panel to provide said panel with a side edge. The second inner side panel further includes a pair of end cuts adjacent the side edge thus providing the second inner side panel with a pair of lateral locking tabs. A second side separator panel is hingedly connected to the bottom edge of the second inner side panel. A second outer side panel is hingedly connected to the second side separator panel, the second outer side panel having a lateral glue flap hingedly connected to one side thereof and a bottom glue flap hingedly connected to the bottom portion thereof. The top glue flap of the second inner side panel and the bottom glue flap of the second outer side panel are adapted to overlap and adhere to one another. The subject blank further includes a central base panel which is disposed between the first and second inner side panels. The base panel has a top glue flap hingedly connected to the top portion thereof. The base panel further includes a first locking slit extending from the top edge of the base panel to the bottom edge thereof, the first locking slit being adjacent to the first inner side panel. The first locking slit includes an elongated central portion and a pair of end portions which are flaired toward the first inner side panel. The side edge of the first inner side panel is receivable in the central portion of the first locking slit, and the lateral locking tabs of the first inner side panel are receivable in the flared end portions of the first locking slit. The base panel further includes a second locking slit substantially parallel to the first locking slit and adjacent to the second inner side panel. The second locking slit extends the length of the second inner side panel and includes an elongated central portion and a pair of end portions which are flared towards the second inner side panel. The side edge of the second inner side panel is receivable in the central portion of the second locking slit, and the lateral locking tabs of the second inner side panel are receivable in the flared portions of the second locking slit. A base separator panel is hingedly connected to the bottom edge of the base panel. A base cushion panel is hingedly connected to the base separator panel and is disposed between the first and second outer side panels. The base cushion panel has a glue flap hingedly connected to the bottom edge thereof. The top glue flap of the base panel and the bottom glue flap of the base cushion panel are adapted to overlap and adhere to one another.

DETAILED DESCRIPTION OF THE PREFERRED EMBODIMENTS

Figure 1:
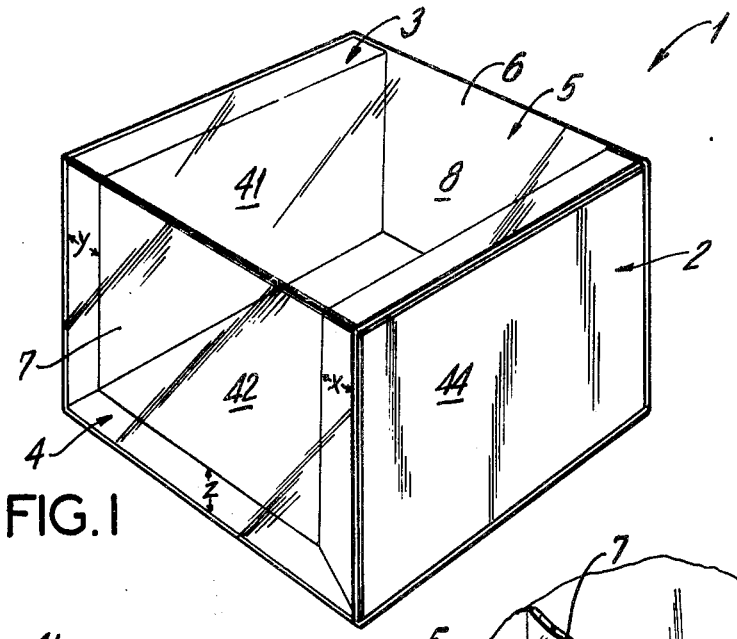
FIG. 1 is a perspective view of the display box of the subject invention.

Referring to FIG. 1, the display box of the subject invention is designated generally by reference numeral 1, and includes a base portion 4 and first and second upstanding sidewalls, 2 and 3, respectively. Sidewalls 2 and 3 are held in a rigid upright position by means of an interlocking relationship between said sidewalls and base portion 4. The specific interlocking relationship will be described in detail below. As illustrated in FIG. 1, first and second sidewalls 2 and 3 and base portion 4 are each generally prismatic in configuration having thicknesses x, y and z, respectively. In addition, as will be described in detail below, said first and second sidewalls and base portion are hollow members each comprising spaced apart panel sections.

Further referring to FIG. 1, the display box 1 of the subject invention includes a tubular plastic, preferably transparent, sleeve member 5 which is disposed over sidewalls 2 and 3 and base portion 4. Thus, the box 1 is provided with a see-through front wall 7, top wall 6, and back wall 8, and an article while being completely enclosed within the box 1 is in plain view to potential purchasers. It will be appreciated that the outermost faces of sidewalls 2 and 3 are not covered by plastic sleeve 5.

Figure 5:
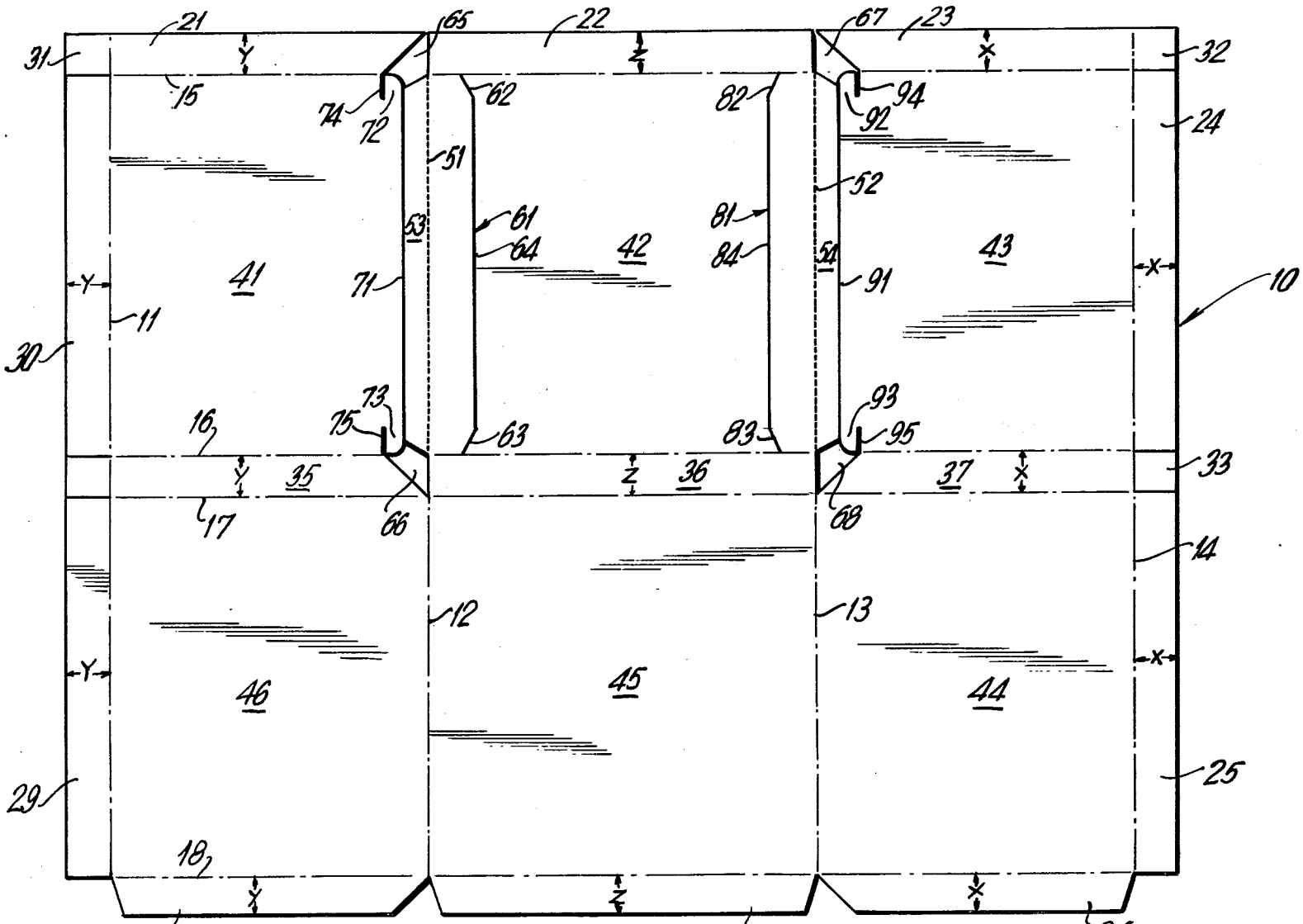
FIG. 5 is a plan view of the blank for forming the display box of the subject invention.

Referring to FIG. 5, the blank for forming the display box of the subject invention comprises a single paperboard substrate 10 having a plurality of cuts, horizontal fold lines 15, 16, 17 and 18, and vertical fold lines 11, 12, 13 and 14, which subdivide the substrate 10 into a plurality of panel sections. More particularly, the blank 10 of the subject invention includes a first inner side panel 43 having an end glue flap 23 hingedly connected thereto along fold line 15 and a lateral glue flap 24 hingedly connected to one side of panel 43 along vertical fold line 14. Preferably, glue flaps 23 and 24 have a width x. A corner flap 32 is also included, said corner flap being hingedly connected to glue flaps 23 and 24.

Referring further to FIG. 5, blank 10 includes a cut extending longitudinally from one end of panel 43 to the other end thereof forming a side edge 91 for panel 43. In addition, panel 43 includes a pair of end cuts 94 and 95 which form a pair of end tabs 92 and 93, respectively.

Referring further to FIG. 5, blank 10 includes a first side separator panel 37 which is hingedly connected to panel 43 along horizontal fold line 16. Preferably, separator panel 37 has a width x. The blank 10 further includes a first outer side panel 44 which is hingedly connected to separator panel 37 along horizontal fold line 17. A lateral glue flap 25 is hingedly connected to panel 44 along vertical fold line 14. In addition, an end glue flap 26 is hingedly connected to panel 44 along horizontal fold line 18. Preferably, glue flaps 25 and 26 have a width x. In accordance with the subject invention, glue flaps 23 and 26 are adapted to overlap and adhere to one another. Similarly, glue flaps 24 and 25 are adapted to overlap and adhere to one another.

Further referring to FIG. 5, the blank 10 includes a second inner side panel 41 having an end glue flap 21 hingedly connected thereto along horizontal fold line 15 and a lateral glue flap 30 hingedly connected to one side thereof along vertical fold line 11. Preferably, glue flaps 21 and 30 have a width y. In addition, it is preferable that there be included a corner flap 31 which is hingedly connected to glue flaps 21 and 30 along fold lines 11 and 15, respectively. The blank 10 also includes a cut extending the length of panel 41 thus forming a side edge 71 for panel 41. Panel 41 also includes a pair of end cuts 74 and 75 which form a pair of end tabs 72 and 73, respectively. A second side separator panel 35 is hingedly connected to panel 41 along horizontal fold line 16, said separator panel preferably having a width y.

Further referring to FIG. 5, a second outer side panel 46 is hingedly connected to separator panel 35 along horizontal fold line 17. A lateral glue flap 29 is hingedly connected to one side of panel 46 along vertical fold line 11 and an end glue flap 28 is hingedly connected to panel 46 along horizontal fold line 18. Preferably, glue flaps 29 and 28 have a width y. In accordance with the subject invention, glue flaps 21 and 28 of second inner and outer panels 41 and 46, respectively, are adapted to overlap and adhere to one another. Similarly, lateral glue flaps 30 and 29 are adapted to overlap and adhere one another.

Further referring to FIG. 5, blank 10 includes a central base panel 42 which is disposed between first and second inner side panels 43 and 41. Base panel 42 includes a first locking slit 81 disposed adjacent first inner side panel 43 and extending longitudinally from one end of panel 42 to the other. Slit 81 comprises a central elongated portion 84 and a pair of end portions 82 and 83 which flare towards first inner side panel 43. In addition, it is preferable that panel 42 include a longitudinal fold line 52 which extends from horizontal fold line 15 to horizontal fold line 16 and defines a reinforcement panel 54. Panel 42 also includes a second locking slit 61 disposed adjacent second inner side panel 41 and extending longitudinally from one end of panel 42 to the other. Second locking slit 61 comprises a central elongated portion 64 and a pair of end portions 62 and 63 which flare toward second inner side panel 41. In addition, it is preferable that panel 42 include a longitudinal fold line 51 extending from horizontal fold line 15 to horizontal fold line 16 and defining a second reinforcement member 53. An end glue flap 22 is hingedly connected to panel 42 along horizontal fold line 15. Preferably, glue flap 22 has a width z.

Further referring to FIG. 5, the blank 10 includes a base separator panel 36 hingedly connected to base panel 42 along horizontal fold line 16. In addition, blank 10 also includes a base cushion panel 45 which is hingedly connected to base separator panel 36 along horizontal fold line 17. Base cushion panel 45 has a glue flap 27 hingedly connected thereto along horizontal fold line 18. In the preferred embodiment of the subject invention, separator panel 36 and glue flap 27 along with glue flap 22 have a width z. In addition, glue flaps 22 and 27 are adapted to overlap and adhere to one another.

Further referring to FIG. 5, blank 10 includes a plurality of cut outs 65–68 disposed adjacent the corners of panel 42 which enables the blank to be folded into the display box 1 of the subject invention.

In constructing the display box of the subject invention, blank 10 is folded along horizontal fold lines 15, 16, 17 and 18 and end glue flaps 21, 22 and 23 overlapped and adhered to end glue flaps 28, 27 and 26, respectively. In addition, lateral flaps 30 and 24 are overlapped and adhered to lateral glue flaps 29 and 25 thus, resulting in the formation of an elongated, hingedly connected, three part, tubular member. It will be noted that panel members 43 and 44 combine to form first side wall 2 of the subject box 1, said panels being spaced apart a distance x, which is, of course, the width of glue flaps 23, 24, 25 and 26, and separator panel 37. Similarly, panels 41 and 46 combine to form second sidewall 3, said panels 41 and 46 being spaced apart a distance y, said distance y being the width of glue flaps 21, 28, 29, 30 and separator panel 35. In addition, base panel 42 combines with cushion panel 45 to form base member 4, said panels 42 and 45 being spaced apart a distance z, said distance corresponding to the width of glue flaps 22 and 27 and separator panel 36.

Figure 2:
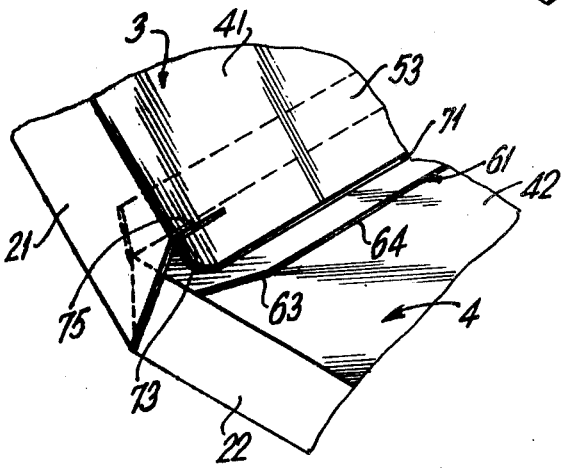
FIG. 2 is a partial perspective view of the display box of the subject invention illustrating a corner of the subject box before the box has been locked into position.
Figure 3:
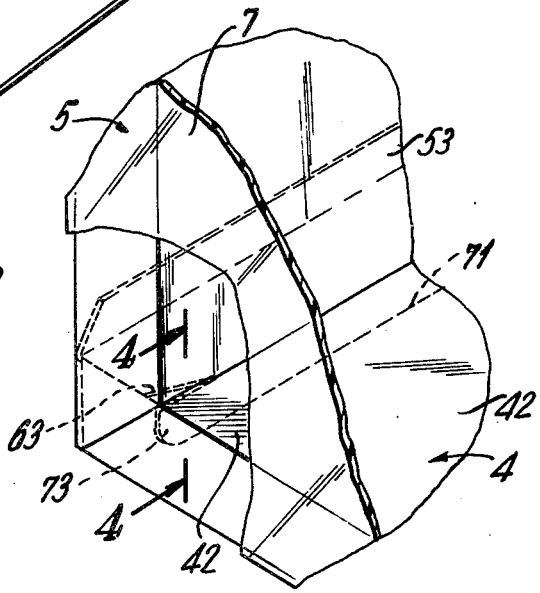
FIG. 3 is a partial perspective view of the display box of the subject invention illustrating a corner of the box after the box has been locked into position.
Figure 4:
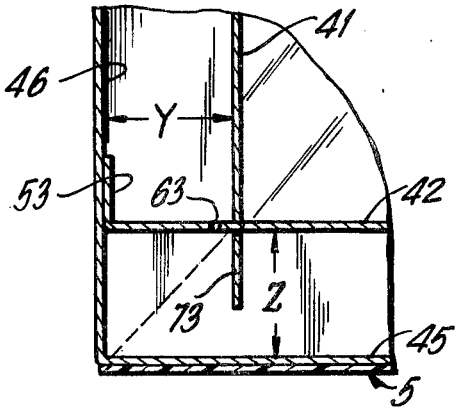
FIG. 4 is a partial, elevational cross-section of the display box of the subject invention taken along lines 4—4 of FIG. 3.

Referring to FIGS. 2–4, there is illustrated the interlocking relationship between sidewalls 2 and 3 and base member 4. As shown in said figures, a portion of inner panel 41 of side panel 3 is receivable in locking slit 61 of base member 4. More particularly, edge 71 of second inner panel 41 is receivable in central portion 64 of slit 61 and end tab 73 of panel 41 is receivable in flared end slit portion 63. While only one corner of the subject box is illustrated in FIGS. 2–4, it will be noted that end tab 72 of panel 41 is receivable in flared end slit portion 62. Similarly, edge 91 of first inner panel 43 is receivable in central slit portion 84 of locking slit 81 and that end tabs 92 and 93 of panel 43 are receivable in flared end slit portions 82 and 83, respectively, of locking slit 81. Referring specifically to FIGS. 2 and 3, it will be noted that in order to insert end tabs 72, 73 and 92, 93 into their respective end slit portions, it is necessary to bend said end tabs in accordance with the flares of their respective end slit portions. It will further be noted referring specifically to FIG. 3, that after said end tabs have been fully inserted into their respective locking slits, that said end tabs return to their normal position such that they are no longer disposed in alignment with their respective flared end slit portions. As a result, inner panels 41 and 43 and thus, sidewalls 3 and 2, respectively, of the subject box are effectively locked into position. Referring to FIG. 4, it will be noted that in the locked position reinforcement panel 53 lies flush against outer side panel 46 of sidewall 3. It will be appreciated that similar thereto, reinforcement panel 54 lies flush against outer side panel 44 of sidewall 2 when said sidewall 2 is in the fully erect position.

In summary, the subject invention provides a new and improved display box which is made from a single sheet of paperboard material and is simple in construction and relatively inexpensive to manufacture. The subject box includes a central base portion and a pair of upstanding sidewalls having a specific interlocking relationship with said base. Although the subject box is made from a single sheet of paperboard, the sidewalls and base portion thereof are each generally prismatic in configuration, each having spaced apart panel sections. As a result, the subject box is quite sturdy. In addition, the provision of spaced apart panel sections for the base and sidewalls provides a cushioning effect to better protect the article enclosed within the box.

While the preferred embodiment of the subject invention has been described and illustrated, it would be obvious that various changes and modifications can be made therein without departing from the spirit of the invention which should be limited only by the scope of the appended claims.

What is claimed is:

1. A cylinder type display box made from a single sheet of paperboard material, said box including a base and first and second upstanding sidewalls, said box further including a plastic sleeve member disposed over said base and sidewalls so as to form a plastic front wall, top wall, and back wall, said base and sidewalls being generally prismatic in configuration, said first side wall including a first inner side panel and a spaced apart substantially parallel first outer side panel, said second sidewall including a second inner side panel and a spaced apart substantially parallel second outer side panel, said base including a base panel and a spaced apart substantially parallel base cushion panel, said base including a pair of substantially parallel locking slits extending from said front wall to said back wall, each of said slits being adjacent to one of said sidewalls, the opposite ends of each slit being flared toward its respective adjacent sidewall, each of said sidewalls including a locking portion receivable in the slit adjacent thereto, each of said locking portions including a central portion integral with its respective sidewall and a pair of end tabs, the end tabs being received in the flared portions of its respective slit for locking the sidewalls into the base portion.

2. A cylinder type display box as recited in claim 1 in which said sleeve member is transparent.

3. A cylinder type display box as recited in claim 1 which further includes a first reinforcement panel hingedly connected to said base panel and extending the length of said base panel, said first reinforcement panel being disposed flush against said first outer side panel and perpendicular to said base panel.

4. A cylinder type display box as recited in claim 1 which further includes a second reinforcement panel hingedly connected to said base panel and extending the length of said base panel, said second reinforcement panel being disposed flush against said second outer side panel and perpendicular to said base panel.

5. A cylinder type display box made from a single sheet of paperboard material, said box including a base and first and second upstanding sidewalls, said box further including a transparent plastic sleeve member disposed over said base and sidewalls so as to form a plastic front wall, top wall, and back wall, said base and sidewalls being generally prismatic in configuration, said first sidewall including a first inner side panel and a spaced apart substantially parallel first outer side panel, said second sidewall including a second inner side panel and a spaced apart substantially parallel second outer side panel, said base including a base panel and a spaced apart substantially parallel base cushion panel, said base including a pair of substantially parallel locking slits extending from said front wall to said back wall, each of said slits being adjacent to one of said sidewalls, the opposite ends of each slit being flared toward its respective adjacent sidewall, each of said sidewalls including a locking portion receivable in the slit adjacent thereto, each of said locking portions including a central portion integral with its respective sidewall and a pair of end tabs, the end tabs being received in the flared portions of its respective slit for locking the sidewalls into the base portion, said display box further including a first reinforcement panel hingedly connected to said base panel and extending the length of said base panel, said first reinforcement panel being disposed flush against said first outer side panel and perpendicular to said base panel, and a second reinforcement panel hingedly connected to said base panel and extending the length of said base panel, said second reinforcement panel being disposed flush against said second outer side panel and perpendicular to said base panel.

6. A blank for forming a cylinder type display box having a base portion and two sidewalls, said base portion and sidewalls each being generally prismatic in configuration and having spaced apart panel sections, said blank comprising a substantially rectangular paperboard substrate having a plurality of cuts and vertical and horizontal fold lines subdividing said substrate into a plurality of panel members, said blank comprising:

a first inner side panel having a top glue flap hingedly connected to the top edge thereof and a lateral glue flap hingedly connected to one side thereof, the other side of said first inner side panel being cut from said substrate, to form a side edge, said first side panel including a first cut extending from the top portion of said first inner side panel to an intermediate portion thereof and a second cut extending from the bottom portion of said first inner side panel to an intermediate portion thereof, thus, forming a pair of opposed lateral locking tabs disposed adjacent said side edge;

a first side separator panel hingedly connected to the bottom portion of said first inner side panel;

a first outer side panel hingedly connected to said first side separator panel, said first outer side panel having a lateral glue flap hingedly connected to one side thereof and a bottom glue flap hingedly connected to the bottom portion thereof, the top glue flap of said first inner side panel and the bottom glue flap of said outer first side panel being adapted to overlap and adhere to each other;

a second inner side panel having a top glue flap hingedly connected to the top edge thereof and a lateral glue flap hingedly connected to one side thereof, the other side of said second inner side panel being cut from said substrate to provide said second inner side panel with a side edge, said second inner side panel having a top cut extending from the top portion thereof to an intermediate portion thereof and a bottom cut extending from the bottom portion thereof to an intermediate portion thereof, said top and bottom cuts forming a pair of opposed lateral locking tabs disposed adjacent the side edge of said second inner side panel;

a second side separator panel hingedly connected to the bottom portion of said second inner side panel;

a second outer side panel hingedly connected to said second side separator panel, said second outer side panel having a lateral glue flap hingedly connected to one side thereof and a bottom glue flap hingedly connected to the bottom edge thereof, the top glue flap of said second outer side panel being adapted to overlap and adhere to one another;

a central base panel disposed between said first and second inner side panels, said base panel having a top glue flap hingedly connected to the top portion thereof, said base panel further including a first locking slit extending the length of said base panel, said first locking slit being adjacent to said first inner side panel, said first locking slit having an elongated central portion and a pair of end portions which are flared towards said first inner side panel, the side edge of said first inner side panel being receivable in said central portion of the first locking slit and the lateral locking tabs of said first inner side panel being receivable in the flared portions of said first locking slit, said base panel further including a second locking slit substantially parallel to said first locking slit and adjacent to said second inner side panel, said second locking slit having an elongated central portion and a pair of end portions which are flared towards said second inner side panel, the side edge of said second inner side panel being receivable in said central portion of said second locking slit and the lateral locking tabs of said second inner side panel being receivable in the flared portions of said second locking slit;

a base separator panel hingedly connected to the bottom edge of said base panel; and a base cushion panel hingedly connected to said base separator panel and disposed between said first and second outer side panels, said base cushion panel having a glue flap hingedly connected to the bottom portion thereof, the top glue flap of said base panel and the bottom glue flap of said base cushion panel being adapted to overlap and adhere to one another.

7. A blank as recited in claim 6 which further includes a first reinforcement flap hingedly connected to said base panel and extending the length of said base panel, said first reinforcement panel being disposed between said base panel and said first inner side panel.

8. A blank as recited in claim 6 which further includes a second reinforcement flap hingedly connected to said base panel and extending the length of said base panel, said second reinforcement panel being disposed between said base panel and said second inner side panel.

9. A blank as recited in claim 6 in which the widths of the top glue flap of said first inner side panel, the first side separator panel, and the bottom glue flap of said first outer side panel are substantially the same.

10. A blank as recited in claim 9 in which the widths of the lateral glue flaps of said first inner side panel and said first outer side panels are substantially the same.

11. A blank as recited in claim 6 in which the widths of the top glue flap of said base panel, the bottom glue flap of said base cushion panel, and the base separator panel are substantially the same.

12. A blank as recited in claim 6 in which the widths of said top glue flap of said second inner side panel, said second side separator panel, and the bottom glue flap of said second outer side panel are substantially the same.

13. A blank as recited in claim 12 in which the width of the lateral glue flaps of said second inner and outer side panels are substantially the same.

* * * * *